US006667462B2

(12) United States Patent
Lo

(10) Patent No.: US 6,667,462 B2
(45) Date of Patent: Dec. 23, 2003

(54) ELECTRIC HAIR WAVER

(75) Inventor: Hou On Lo, Kowloon (HK)

(73) Assignee: Hexagear Industries Limited, Kowloon (HK)

( * ) Notice: Subject to any disclaimer, the term of this patent is extended or adjusted under 35 U.S.C. 154(b) by 112 days.

(21) Appl. No.: 10/066,022

(22) Filed: Jan. 31, 2002

(65) Prior Publication Data

US 2003/0071027 A1 Apr. 17, 2003

(30) Foreign Application Priority Data

Oct. 12, 2001 (HK) ..... 01267485

(51) Int. Cl.[7] ..... A45D 1/04
(52) U.S. Cl. ..... 219/225
(58) Field of Search ..... 219/225, 222, 219/223, 231; 132/224, 225, 226, 227, 229, 231, 232, 234, 269

(56) References Cited

U.S. PATENT DOCUMENTS 4,365,140 A * 12/1982 Bast et al. ..... 219/225
4,477,716 A * 10/1984 Thaler et al. ..... 219/225
4,533,819 A * 8/1985 Valiulis ..... 219/225
5,354,967 A * 10/1994 Barzilai et al. ..... 219/225
5,832,939 A * 11/1998 Nathe ..... 132/225
6,014,977 A * 1/2000 Friedman ..... 132/232

* cited by examiner

*Primary Examiner*—Teresa Walberg
*Assistant Examiner*—Vinod D. Patel
(74) *Attorney, Agent, or Firm*—Alix, Yale & Ristas, LLP

(57) ABSTRACT

An electric hair waver includes a handle and a clip. The clip is hinged to the handle and forms a clamp with the handle by means of the spring. A sealed lower semi-barrel is fixed on the forward end of the handle. An upper semi-barrel and the clip are all hinged to the handle, and the clip is also joined with the upper semi-barrel by a flexible connection. A heater that is connected to the power cord is installed respectively inside the upper semi-barrel and lower semi-barrel, and the front of them links with the lower temperature head through the insulation sheath. The flexible connection includes a strip keyhole with a large circle that locates on the clip and a joint-pin fitted on the upper semi-barrel that matches the strip keyhole. The push button fixed on the handle is connected to the joint-pin through a drawbar, and there is reset spring between the push button and the handle. The hair waver can heat hair uniformly and permanently set not only curled hair, but also straight hair.

20 Claims, 3 Drawing Sheets

PRIOR ART

ELECTRIC HAIR WAVER

BACKGROUND OF THE INVENTION

The present invention relates generally to a kind of electric hair wavers.

With reference to FIG. 1 and FIG. 2, the conventional electric hair waver is fitted with thermal insulating sleeve 13 on its handle 2. Aluminum barrel 1 is fixed on the front end of sleeve 13. An insulation sheath 6 and lower temperature head 7 are installed one by one onto the front end of aluminum barrel 1. Clip 5 is hinged to the aluminum barrel and forms a clamp with the handle by means of spring 12 fitted between them. The front part of clip 5 is extended to the front end of the barrel. The heating element 4 inside barrel 1 is successively connected through the wire with indicator 9, switch 10 and power cord 11 that are all installed inside handle 2. This kind of hair waver can permanently set curled hair, but is not for the permanent setting of straight hair. When people want to straighten the hair that is out of shape, this kind of hair waver cannot satisfy the demand. In addition, in hair curling, the temperature of the clip of the waver is lower than that temperature of the barrel. This causes uneven heating in different parts of hair, which brings about undesirable curling effects.

SUMMARY OF THE INVENTION

An objective of the present invention is to provide a new and improved electric hair waver that heats hair uniformly and can permanently set not only curled hair but also straight hair.

Briefly stated, the invention in a preferred form is a hair waver that includes a handle and a clip. The clip is hinged to the handle and forms a clamp with the handle by means of a spring. A sealed lower semi-barrel is fixed on the front end of the handle. An upper semi-barrel and the clip are all hinged to the handle, and the clip is also joined with the upper semi-barrel by a flexible connection. The heater that is connected to the power cord is installed respectively inside of the upper semi-barrel and lower semi-barrel, and the front of them links with a lower temperature head through an insulation sheath. The flexible connection includes a strip keyhole with a large circle that locates on the clip and a joint-pin fitted on the upper semi-barrel that matches the strip keyhole. A push button fixed on the handle is connected to the joint-pin through the drawbar. A reset spring is disposed between the push button and the handle.

These two semi-barrels in accordance with one preferred embodiment are fitted with PTC heaters, which possess the features of temperature stabilization so that the hair can be heated uniformly with a uniform temperature. In addition, the flat surfaces of these two semi-barrels can be used to clamp the hair. Traditional curled hair can be formed by rolling, and if moving along the hair, the required straight hairstyle can be obtained. In addition, the hair may be fitted with semi-barrels having different shapes of surfaces, so that the hair can be permanently set in a variety of hairstyles, such as the hair with small waves, etc.

BRIEF DESCRIPTION OF THE DRAWINGS

Further description is given below with attached drawings and practical examples in which.

DESCRIPTION OF THE PREFERRED EMBODIMENTS

Figure 1:
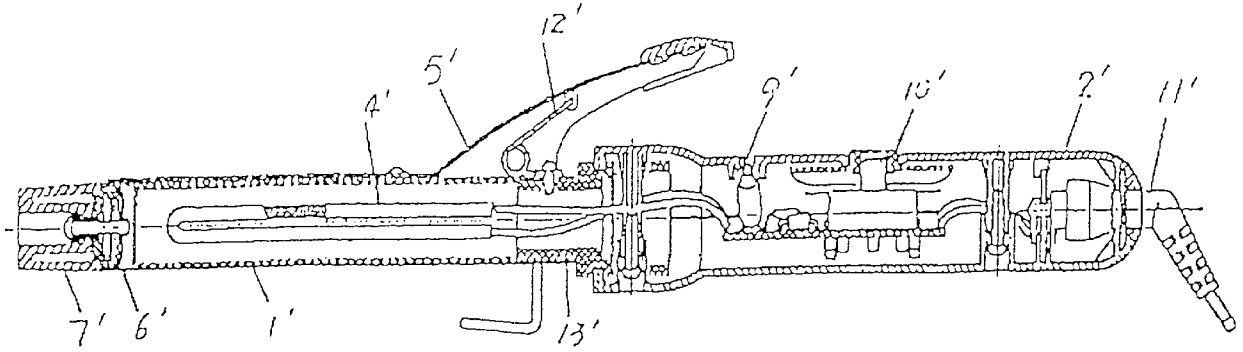
FIG. 1 is a schematic diagram of the inner structure of a conventional electric hair waver.
Figure 2:
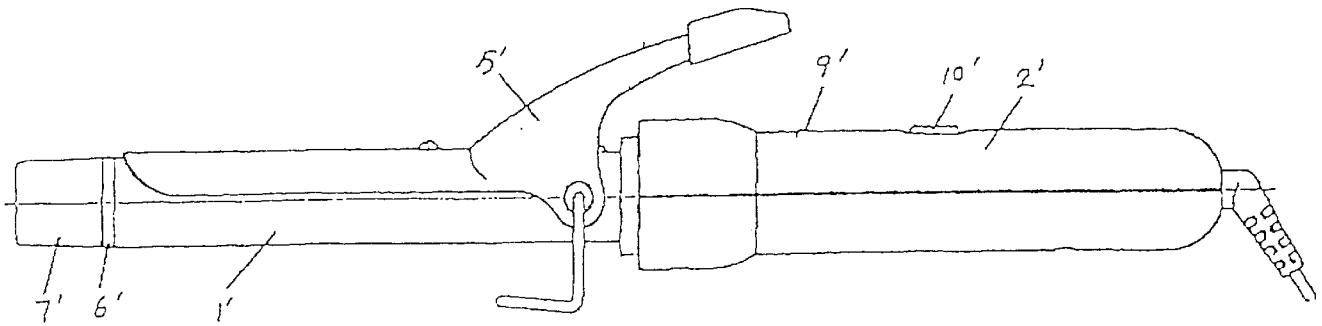
PRIOR ART Figure 2
FIG. 2 is a general view for the conventional electric hair waver of FIG. 1.
Figure 3:
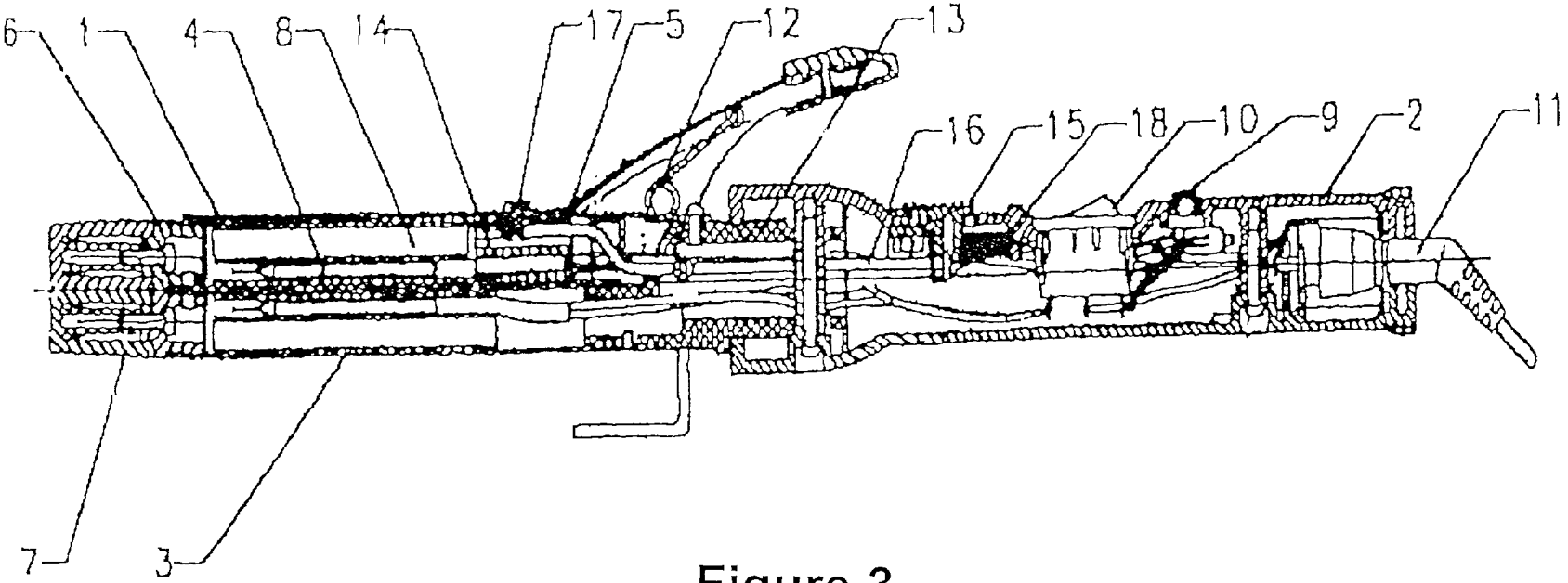
FIG. 3 is a sectional view of one embodiment of an electric hair waver in accordance with the present invention.
Figure 4:
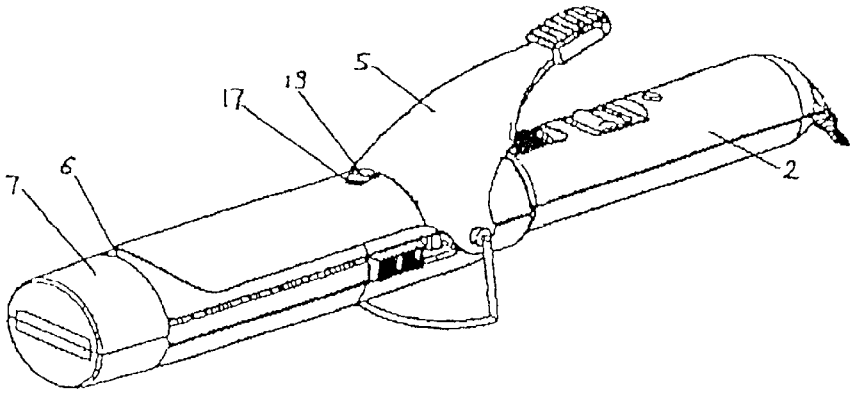
FIG. 4 is a perspective view of the embodiment shown in FIG. 3 for a first operation condition.
Figure 5:
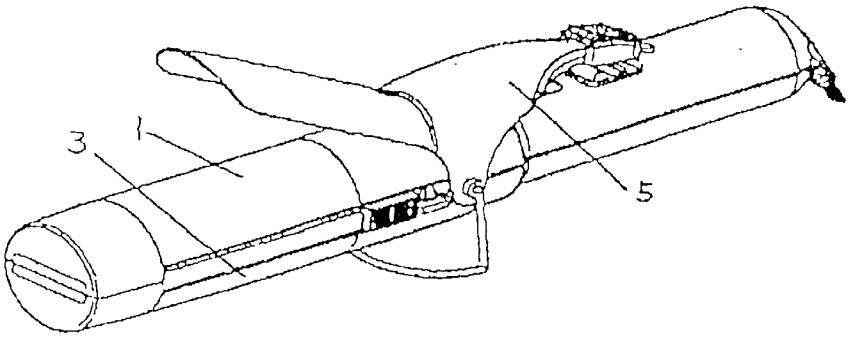
FIG. 5 is a perspective view of the embodiment shown in FIG. 3 for a second operation condition.

With reference to FIGS. 3, 4, and 5, a hair waver in accordance with the invention includes a handle 2 and a clip 5. Clip 5 is hinged to handle 2 and forms the clamp with the handle by means of spring 12. A sealed lower semi-barrel 3 is fixed on the front end of the handle 2. An upper semi-barrel 1 and the clip 5 are all hinged to handle 2. Clip 5 is also joined with the upper semi-barrel 1 by a flexible connection.

A heater 4 that is connected with a power cord is installed respectively inside upper semi-barrel 1 and lower semi-barrel 3. The front of the barrels links with lower temperature head 7 through an insulation sheath 6.

Figure 7:
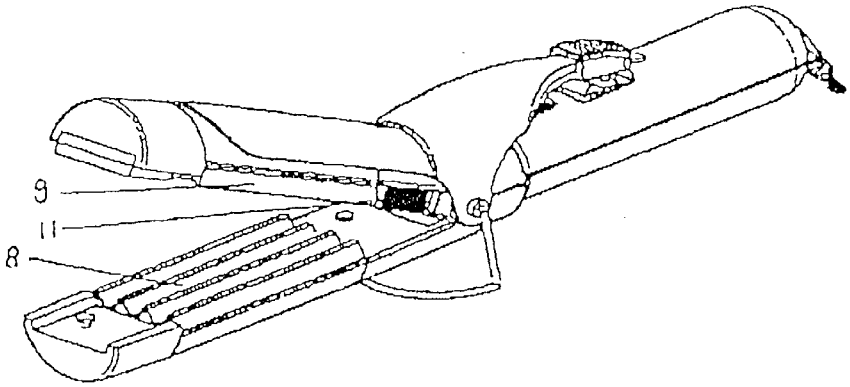
FIG. 7 is a perspective view of the embodiment shown in FIG. 3 for a fourth operation condition.

The flexible connection includes a strip keyhole 19 with a large circle that locates on the clip 5 and a joint-pin 17 fitted on the upper barrel that matches the strip keyhole. A push button 15 fixed on the handle 2 is connected to the draw-pin through a drawbar 16. Reset spring 18 is fitted between the push button and the handle. In addition as shown in FIG. 7, there are meshing elongated sawtooth lugs 8 on the opposite surfaces of the upper semi-barrel and the lower semi-barrel. The sawtooth lugs 8 of upper semi-barrel are located on a moving meshing plate 9. The meshing plate 9 links with a movable joint bar 11 that is hinged to handle 2. Joint bar 11 also has a strip keyhole 19 with a large circle on it, which matches the joint-pin 17 that is fixed on the upper semi-barrel. The other parts of this embodiment are substantially the same as conventional electric hair wavers.

Through the reciprocating movement of push button 15 inside handle 2, drawbar 16 is moved and makes the joint-pin 17 move back and forth in the strip hole 19. As shown in FIG. 4, if the push button 15 is pushed to the left, the head of the joint-pin 16 will align with the large circle of the keyhole in clip 5, and therefore, clip 5 can swing up and down to clamp and roll the hair. This is the curling function of the waver.

With reference to FIG. 5, if the push button 15 is pushed to the right, the joint-pin 17 goes right and enters into the narrow hole of the keyhole in clip 5, then the clip and the upper semi-barrel are integrated into an organic whole by joint-pin 17. Consequently, the upper semi-barrel and lower semi-barrel can be driven by the clamp to provide the operation of hair straightening.

Figure 6:
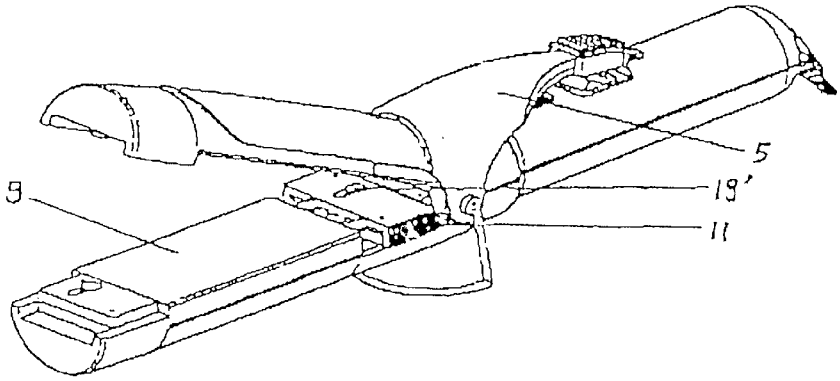
FIG. 6 is a schematic diagram of the embodiment shown in FIG. 3 for a third operation condition.

As shown in FIG. 6, if joint-pin 17 turns left and enters into the narrow hole of the keyhole in meshing plate 9, then meshing plate 9 and the upper semi-barrel are integrated into an organic whole by joint-pin 17. As a result, the upper semi-barrel with meshing plate can be advanced by the clip to swing up and down the hair, which is being clamped in sawtooth lugs 8 between the meshing plate and the lower semi-barrel. By this way, the hairstyle with small waves or combinations of hairstyles can be permanently set.

What is claimed:

1. A hair waver comprising:

a handle having a first and second semi-barrel section fixed to a forward portion thereof;

an electric heater installed inside said first and second semi-barrel sections;

a clip hingedly connected to said handle, a spring biasing said clip so that said handle and clip form a clamp against said first semi-barrel section;

a flexible connection joining said clip and first semi-barrel section and comprising a pin mounted to the first semi-barrel section and configured for reception in a slot having a reduced and an enlarged portion defined in said clip; and an actuator mounted on the handle and a linkage connecting said actuator and pin to selectively govern the position of the pin in said slot to thereby selectively lock or release pivoting of said clamp to permit said first semi-barrel section to pivot relative to said second barrel section.

2. The hair waver of claim 1 wherein said slot has a keyhole shape.

3. The hair waver of claim 1 further comprising a reset spring disposed between the actuator and the handle.

4. The hair waver of claim 1 wherein the actuator is a push button.

5. The hair waver of claim 1 further comprising a head disposed at a frontal portion of the first and second semi-barrel sections and being thermally insulated from said heater.

6. The hair waver of claim 1 wherein said first and second semi-barrel sections further comprise opposite surfaces having sawtooth lugs.

7. The hair waver of claim 6 wherein the sawtooth lugs of said first semi-barrel section are disposed on a movable plate.

8. The hair waver of claim 7 wherein the plate links with a movable joint bar hinged to said handle.

9. The hair waver of claim 8 wherein the joint bar further has a slot with a reduced and an enlarged portion and said pin is receivable in said portions.

10. The hair waver of claim 1 wherein said first and second sections further comprise opposite surfaces having meshing sawtooth lugs.

11. The hair waver of claim 10 wherein the sawtooth lugs of said first section are disposed on a movable plate.

12. The hair waver of claim 11 wherein the plate links with a movable member hinged to said handle.

13. The hair waver of claim 12 wherein the member further has a slot with a reduced and an enlarged portion and said pin is receivable in said portions.

14. A hair waver comprising:

a handle having elongated cooperating first and second sections mounted to a forward portion thereof;

an electric heater installed inside said sections;

a clip hingedly connected to said handle, a spring biasing said clip so that said handle and clip form a clamp against said first section;

a flexible connection joining said clip and first section and comprising a pin mounted to the first section and configured for reception in a slot defined in said clip; and an actuator mounted on the handle and a linkage connecting said actuator and pin to selectively govern the position of the pin in said slot to thereby selectively lock or release pivoting of said clamp to permit said first section to pivot relative to said second section.

15. The hair waver of claim 14 wherein said slot has a keyhole shape.

16. The hair waver of claim 14 further comprising a reset spring disposed between the actuator and the handle.

17. The hair waver of claim 14 wherein the actuator is a push button.

18. The hair waver of claim 14 further comprising a head disposed at a frontal portion of the first and second sections and being thermally insulated from said heater.

19. The hair waver of claim 14 wherein the sections have a semi-barrel shape.

20. A hair waver comprising:

a handle having elongated cooperating first and second sections mounted to a forward portion thereof;

an electric heater installed inside said sections;

a clip having an elongated arcuate frontal portion and an obliquely extending rear portion, said clip hingedly connected to said handle, a spring biasing said clip so that said handle and clip form a clamp against said first section;

a flexible connection joining said clip and first section and comprising a pin mounted to the first section and configured for reception in a slot defined in said clip; and an actuator mounted on the handle to selectively govern the position of the pin in said slot to thereby selectively lock or release pivoting of said clip to permit said first section to pivot relative to said second section.

* * * * *

UNITED STATES PATENT AND TRADEMARK OFFICE

CERTIFICATE OF CORRECTION

PATENT NO. : 6,667,462 B2
DATED : December 23, 2003
INVENTOR(S) : Lo

It is certified that error appears in the above-identified patent and that said Letters Patent is hereby corrected as shown below:

Title page,
Item [30], Foreign Application Data, delete "(HK)" and insert therefore -- (CN) --; and insert -- Dec. 4, 2001 ….. (CN) ……... 01271884 --.

Signed and Sealed this

Fourth Day of May, 2004

JON W. DUDAS
*Acting Director of the United States Patent and Trademark Office*